US010676997B2

(12) United States Patent
Comarmond

(10) Patent No.: US 10,676,997 B2
(45) Date of Patent: Jun. 9, 2020

(54) HYDRAULIC DRILLING APPARATUS INTENDED TO DRILL BOREHOLES

(71) Applicant: MONTABERT, Saint-Priest (FR)

(72) Inventor: Jean-Sylvain Comarmond, Vourles (FR)

(73) Assignee: MONTABERT, Saint-Priest (FR)

( * ) Notice: Subject to any disclaimer, the term of this patent is extended or adjusted under 35 U.S.C. 154(b) by 572 days.

(21) Appl. No.: 15/512,381

(22) PCT Filed: Sep. 4, 2015

(86) PCT No.: PCT/FR2015/052349

§ 371 (c)(1),
(2) Date: Mar. 17, 2017

(87) PCT Pub. No.: WO2016/042234

PCT Pub. Date: Mar. 24, 2016

(65) Prior Publication Data

US 2017/0275958 A1 Sep. 28, 2017

(30) Foreign Application Priority Data

Sep. 18, 2014 (FR) ..... 14 58798

(51) Int. Cl.
*E21B 17/18* (2006.01)
*B25D 9/12* (2006.01)
(Continued)

(52) U.S. Cl.
CPC ..... *E21B 17/18* (2013.01); *B25D 9/12* (2013.01); *B25D 17/00* (2013.01); *E21B 6/02* (2013.01);
(Continued)

(58) Field of Classification Search
CPC ..... B25C 1/16; B25D 2250/241; B25D 2250/121; B25D 2250/171; B25D 2250/065; B25D 9/04; B25D 17/00; B25D 17/005; B25D 17/02; B28D 1/146
USPC ..... 173/90, 184, 213
See application file for complete search history.

(56) References Cited

U.S. PATENT DOCUMENTS 4,494,614 A * 1/1985 Eklof ..... B25D 9/12 173/112
5,259,464 A * 11/1993 Bartels ..... B25D 9/12 173/129
(Continued)

FOREIGN PATENT DOCUMENTS

AU 567902 B2 * 12/1987 ..... B23Q 1/0036
EP 0113654 A2 7/1984
(Continued)

OTHER PUBLICATIONS

English Translation of Abstract for EP0113654.
(Continued)

*Primary Examiner* — Hemant Desai
*Assistant Examiner* — Veronica Martin
(74) *Attorney, Agent, or Firm* — Cantor Colburn LLP

(57) ABSTRACT

This hydraulic drilling apparatus including a casing comprising a front part, a shank including a fluid injection conduit and intended to be coupled to at least one drill rod equipped with a tool, the shank, a striking piston slidably mounted inside the casing along a striking axis (A) and configured to strike the shank, an extraction piston disposed around the shank and comprising an extraction portion configured to cooperate with the shank, and a cartridge removably mounted on the front part and disposed around the shank, the cartridge including an injection part configured to fluidly connect the fluid injection conduit to a fluid delivery conduit. The cartridge delimits a receiving housing in which the extraction piston is slidably mounted.

16 Claims, 4 Drawing Sheets

(51) Int. Cl.

| | |
|---|---|
| ***B25D 17/00*** | (2006.01) |
| ***E21B 6/02*** | (2006.01) |
| ***E21B 7/04*** | (2006.01) |
| ***E21B 7/20*** | (2006.01) |
| ***E21B 10/02*** | (2006.01) |
| *E21B 21/00* | (2006.01) |

(52) U.S. Cl.
CPC ..... *E21B 7/04* (2013.01); *E21B 7/205* (2013.01); *E21B 10/02* (2013.01); *B25D 2250/121* (2013.01); *B25D 2250/171* (2013.01); *E21B 21/00* (2013.01)

(56) References Cited

U.S. PATENT DOCUMENTS

| | | | | |
|---|---|---|---|---|
| 5,413,186 | A * | 5/1995 | Campbell | B25D 9/145 175/135 |
| 2011/0073373 | A1 * | 3/2011 | Rodert | B25D 17/005 175/94 |

FOREIGN PATENT DOCUMENTS

| | | | |
|---|---|---|---|
| EP | 0168382 | A1 | 1/1986 |
| FR | 2514820 | A1 | 4/1983 |
| FR | 2761112 | A1 | 9/1998 |

OTHER PUBLICATIONS

English Translation of Abstract for EP0168382.
English Translation of Abstract for FR2514820.
English Translation of Abstract for FR2761112.
International Search Report for International Application No. PCT/FR2015/052349.

* cited by examiner

HYDRAULIC DRILLING APPARATUS INTENDED TO DRILL BOREHOLES

TECHNICAL FIELD

The present invention concerns a hydraulic drilling apparatus, for example of rotary-percussive type, intended for the drilling of boreholes.

BACKGROUND

Drilling machines are used in various applications, such as the drilling of quarries, tunnels or mines. These machines are composed of a carrier part, called carrier, on which there is a slide rail, said slide rail receiving a hydraulic drilling apparatus.

A hydraulic drilling apparatus includes, in a known manner:

- a casing comprising a front part,
- a shank intended to be coupled to at least one drill rod equipped with a tool, such as a drilling bit, the shank including a fluid injection conduit capable of injecting a fluid, such as water or air in the at least one drill rod so as to extract from the boreholes the destroyed pieces of rock,
- a striking piston slidably mounted inside the casing along a striking axis and configured to strike the shank,
- an extraction piston slidably mounted inside the front part of the casing and disposed around the shank, the extraction piston comprising an extraction portion configured to cooperate with the shank, and
- a cartridge removably mounted on the front part and disposed around the shank, the cartridge including an injection part intended to be connected to a fluid delivery conduit, the injection part being configured to fluidly connect the fluid injection conduit to the fluid delivery conduit.

Such a hydraulic drilling apparatus allows easily removing the tool from the rock after the completion of the borehole, including when the drilled ground is unstable or faulted. Indeed, when the tool is blocked in the borehole, an operator displaces the casing of the hydraulic drilling apparatus away from the tool until the extraction portion of the extraction piston bears against the shank which is secured to the tool through the drill rod(s), and actuates hydraulic circuits for controlling the striking piston such that said striking piston strikes the shank. A shock wave is therefore transmitted to the extraction piston which is projected forwards in the direction of a recoil chamber containing an elastic oil cushion capable of exerting a thrust force on the extraction piston biasing said extraction piston backwards causing an impact against the shank ensuring a release of the tool out of the borehole.

A drawback of such a hydraulic drilling apparatus lies in the fact that a replacement of the shank, which is a wear part whose regular replacement is necessary (approximately every 30 to 50 hours), requires a disassembly of the front part of the casing which integrates the extraction piston and the associated hydraulic circuits and which is held by a plurality of tie rods (generally between 2 and 4 tie rods). This front part of the casing is very heavy, and its disassembly requires a specific tooling. Furthermore, during the intervention time, oil flows from the hydraulic circuits associated with the extraction piston, which results in oil loss and soil pollution.

BRIEF SUMMARY

The present invention aims to remedy all or part of these drawbacks.

The technical problem underlying the invention comprises in particular in providing a hydraulic drilling apparatus whose structure is simple and economical, while allowing an easy and quick replacement of the shank.

To this end, the present invention concerns a hydraulic drilling apparatus intended to drill boreholes, including:

- a casing comprising a front part,
- a shank intended to be coupled to at least one drill rod equipped with a tool, the shank including a fluid injection conduit,
- a striking piston slidably mounted inside the casing along a striking axis and configured to strike the shank,
- an extraction piston disposed around the shank, the extraction piston comprising an extraction portion configured to cooperate with the shank,
- a cartridge removably mounted on the front part and disposed around the shank, the cartridge delimiting a receiving housing in which the extraction piston is slidably mounted, the cartridge including:
  - an injection part intended to be connected to a fluid delivery conduit, the injection part being configured to fluidly connect the fluid injection conduit to the fluid delivery conduit, and
  - a support body removably mounted on the front part, the support body including a first end portion facing the front part and delimiting at least partially the receiving housing, and a second end portion opposite to the first end portion and on which the injection part is removably mounted, the first end portion of the support body forming a threaded mounting portion configured to cooperate with a complementary tapped mounting portion provided on the front part.

Such a mounting of the extraction piston in the cartridge allows easy access to the shank, and therefore the replacement thereof, simply by disassembling the cartridge from the front part of the casing using a simple tooling, such as for example a pin wrench or a metallic rod. Thus, the hydraulic drilling apparatus according to the invention does not require, unlike the apparatuses of the prior art, a disassembly the front part of the casing, and hence ensures a simple and quick replacement of the shank.

Moreover, such mounting of the support body on the front part allows quick and easy access to the shank.

Furthermore, such a mounting of the injection part ensures, in case of wear of the sealing elements carried by the injection part, a flow of the injection fluid directly outwardly from the drilling apparatus without risk of polluting the hydraulic parts for controlling the apparatus. Moreover, such a mounting of the injection part on the support body allows a quick and independent change of the injection part.

According to an embodiment of the invention, the injection part forms an injection nozzle disposed in a frontal part of the cartridge.

According to an embodiment of the invention, the cartridge comprises a fastening member removably mounted on the support body, the fastening member being configured to fasten the injection part on the support body.

According to an embodiment of the invention, the fastening member is mounted by screwing on the support body. For example, the fastening member comprises a tapped mounting portion arranged to cooperate with a threaded mounting portion provided on the support body.

According to an embodiment of the invention, the fastening member is a fastening ring.

According to an embodiment of the invention, the injection part includes an injection body disposed around the shank, the injection body including a supply inlet intended to be connected to the fluid delivery conduit and an annular inner groove fluidly connected to the supply inlet, the shank including a communication orifice configured to fluidly connect the annular inner groove and the fluid injection conduit.

According to an embodiment of the invention, the injection part includes a joining member mounted on the supply inlet and configured to be joined to the fluid delivery conduit.

According to an embodiment of the invention, the injection body includes, on its outer surface, an annular slot and the injection part includes an annular seal mounted in the annular slot and configured to be interposed between the fastening member and the support body.

According to an embodiment of the invention, the hydraulic drilling apparatus system further comprises a drive device configured to drive the shank in rotation about an axis of rotation substantially coincident with the striking axis.

According to an embodiment of the invention, the drive device includes:

a driving motor mounted on the front part and equipped with an output shaft, and at least one coupling member configured to couple the shank and the output shaft in rotation.

According to an embodiment of the invention, the drive device includes a coupling pinion disposed around the shank and coupled in rotation with the shank.

According to an embodiment of the invention, the shank includes a plurality of longitudinal grooves distributed over its outer surface, and the coupling pinion includes a plurality of longitudinal ribs distributed on its inner surface and configured to cooperate with the longitudinal grooves provided on the shank.

According to an embodiment of the invention, the shank comprises an annular bearing portion, for example a bearing collar, configured to cooperate with the extraction portion of the extraction piston.

According to an embodiment of the invention, the cartridge includes at least one retaining member configured to retain the extraction piston in the receiving housing.

According to an embodiment of the invention, the at least one retaining member is configured to limit the displacement stroke of the extraction piston towards the striking piston.

According to an embodiment of the invention, the at least one retaining member is a retaining ring disposed around the extraction piston. The retaining ring may be removably mounted on the support body, and for example by screwing.

According to an embodiment of the invention, the hydraulic drilling apparatus comprises a high-pressure incompressible fluid supply conduit, and in which the cartridge and the extraction piston delimit at least partially a recoil chamber, the recoil chamber being configured to be connected to the high-pressure incompressible fluid supply conduit, for example during at least a part of the displacement stroke of the extraction piston in the receiving housing.

According to an embodiment of the invention, the hydraulic drilling apparatus is configured such that, when the extraction piston performs a displacement stroke opposite to the striking piston, the incompressible fluid contained in the recoil chamber exerts a thrust force on the extraction piston biasing the extraction piston towards the striking piston. Such a recoil of the extraction piston is capable of inducing an impact of the extraction portion of the extraction piston against the shank, which allows ensuring an easy release of the tool carried by the drill rod coupled to the shank.

According to an embodiment of the invention, the recoil chamber is annular.

According to an embodiment of the invention, the recoil chamber is delimited at least partially by the support body and the extraction piston. For example, the recoil chamber is delimited by the support body, the extraction piston and the at least one retaining member.

According to an embodiment of the invention, the cartridge includes a supply circuit configured to fluidly connect the high-pressure incompressible fluid supply conduit to the recoil chamber.

According to an embodiment of the invention, the extraction piston comprises, on its outer surface, an annular collar configured to bear against the at least one retaining member.

According to an embodiment of the invention, the support body delimits at least partially, one first annular outer groove configured to be fluidly connected to the high-pressure incompressible fluid supply conduit, the supply circuit being configured to fluidly connect the first annular outer groove and the recoil chamber.

According to an embodiment of the invention, the hydraulic drilling apparatus comprises at least one obturation member movably mounted on the front part between an obturation position of the high-pressure incompressible fluid supply conduit and an opening position of the high-pressure incompressible fluid supply conduit, the cartridge being configured to bias, when mounted on the front part, the at least one obturation member to the opening position thereof.

According to an embodiment of the invention, the hydraulic drilling apparatus includes a biasing element mounted on the front part and arranged to bias the at least one obturation member towards the obturation position thereof.

According to an embodiment of the invention, the hydraulic drilling apparatus comprises a low-pressure incompressible fluid return conduit, the recoil chamber being configured to be connected to the low-pressure incompressible fluid return conduit during at least one part of the displacement stroke of the extraction piston in the receiving housing.

According to an embodiment of the invention, the cartridge includes a return circuit configured to fluidly connect the low-pressure incompressible fluid return conduit to the recoil chamber.

According to an embodiment of the invention, the support body delimits at least partially a second annular outer groove configured to be fluidly connected to the low-pressure incompressible fluid return conduit, the return circuit is configured to fluidly connect the second annular outer groove and the recoil chamber.

According to an embodiment of the invention, the hydraulic drilling apparatus comprises at least one obturation member movably mounted on the front part between an obturation position of the low-pressure incompressible fluid return conduit and an opening position of the low-pressure incompressible fluid return conduit, the cartridge being configured to bias, when mounted on the front part, the at least one obturation member to the opening position thereof.

According to an embodiment of the invention, the cartridge includes a guide ring mounted on the support body and disposed around the shank, the guide ring being configured to slidably cooperate with the outer surface of the shank. For example, the shank includes a guided portion configured to cooperate with the guide ring.

According to an embodiment of the invention, the cartridge includes at least one first and one second annular sealing elements mounted on the injection body and configured to cooperate with the outer surface of the shank, the first and second sealing elements being disposed respectively on either side of the annular inner groove.

The present invention further concerns a cartridge for a hydraulic drilling apparatus intended to drill boreholes, the cartridge being configured to be removably mounted on a front part of a casing of the hydraulic drilling apparatus and to be disposed around a shank including a fluid injection conduit, the cartridge including an injection part intended to be connected to a fluid delivery conduit, the injection part being configured to fluidly connect the fluid injection conduit to the fluid delivery conduit, the cartridge delimiting a receiving housing in which an extraction piston intended to be disposed around the shank is slidably mounted, the extraction piston comprising an extraction portion configured to cooperate with the shank.

BRIEF DESCRIPTION OF THE DRAWINGS

In any case, the invention will be well understood using the following description with reference to the appended schematic drawing showing, by way of non-limiting example, an embodiment of this hydraulic drilling apparatus.

DETAILED DESCRIPTION

Figure 1:
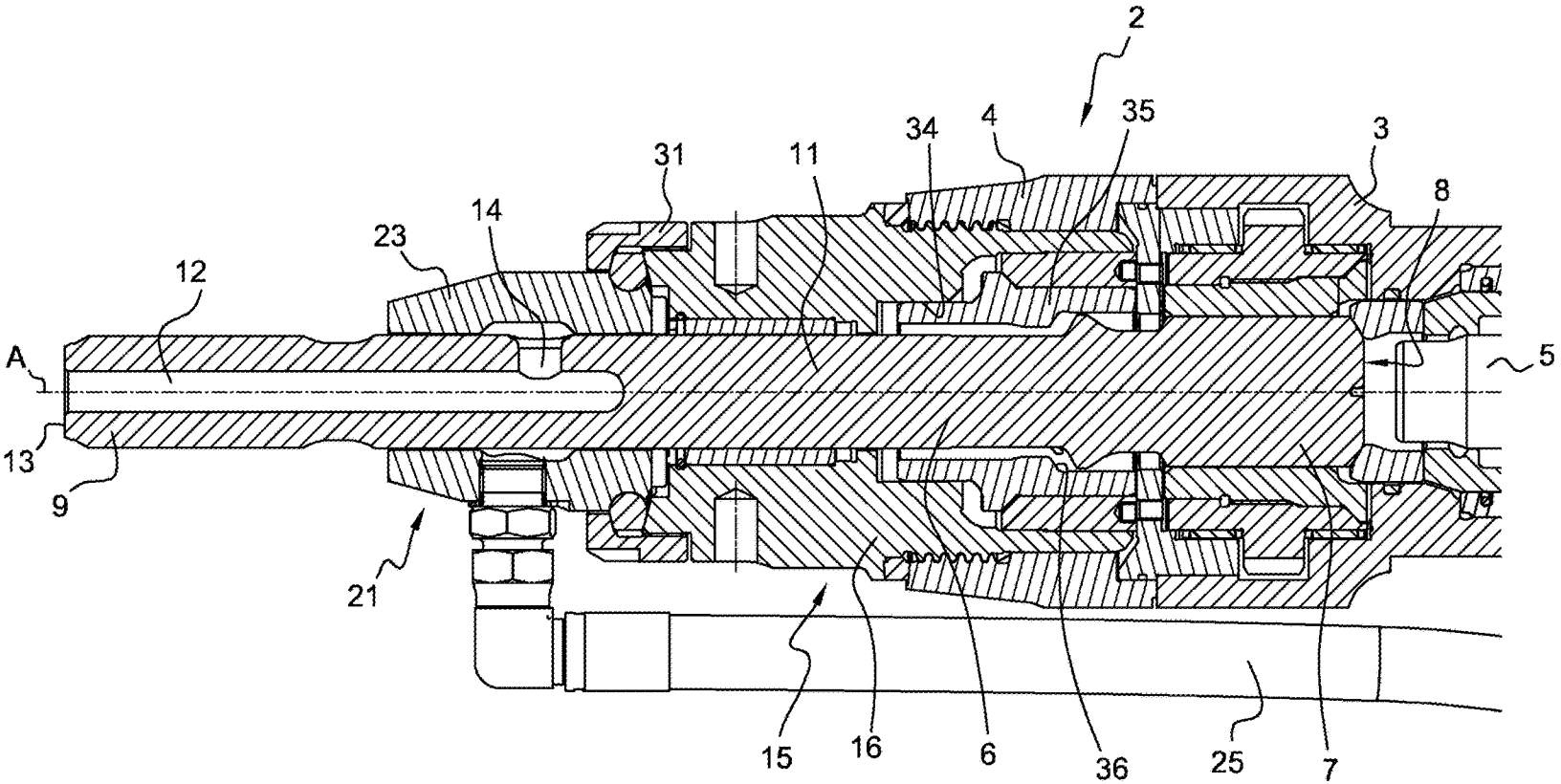
FIG. 1 is a partial longitudinal sectional view of a hydraulic drilling apparatus according to the invention.

FIGS. 1 to 5 represent a hydraulic rotary-percussive hydraulic drilling apparatus 2 intended to drill boreholes.

The drilling apparatus 2 includes a casing 3 comprising a front part 4, and a striking piston 5 slidably mounted inside the casing 3 along a striking axis A. The drilling apparatus 2 further comprises a shank 6 intended to be coupled, in a known manner, to at least one drill rod (not shown in the figures) equipped with a tool.

The shank 6 extends longitudinally along the striking axis A. The shank 6 includes a first end portion 7 facing the striking piston 5 and provided with an end face 8 against which the striking piston 5 is intended to strike, and a second end portion 9, opposite the first end portion 7, intended to be coupled to the at least one drill rod. The shank 6 further includes a cylindrical guided portion 11 disposed between the first and second end portions 7, 9, and a fluid injection conduit 12 longitudinally extending and opening into an end face 13 of the second end portion 9. Furthermore, the shank 6 includes 15 a communication orifice 14 radially opening respectively into the fluid injection conduit 12 and into the outer surface of the shank 6.

The drilling apparatus 2 also includes a cartridge 15 disposed around the shank 6 and removably mounted, for example by screwing, on the front part 4 of the casing 3.

The cartridge 15 includes more particularly a support body 16 delimiting a longitudinal passage for the shank 6. The support body 16 includes a mounting portion 17 facing the front part 4 and configured to cooperate with a complementary mounting portion 18 provided on the front part 4. According to the embodiment shown in the figures, the mounting portion 17 includes, on its inner surface, a thread 19 arranged to cooperate with a tapping 20 provided on the inner surface of the mounting portion 18.

Figure 3:
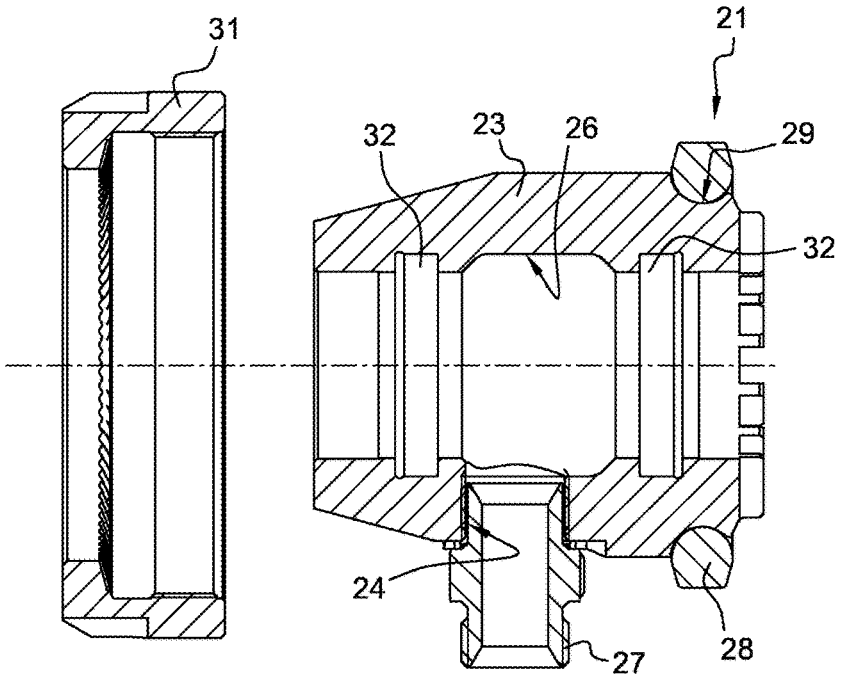
FIG. 3 is a longitudinal sectional view of an injection part and a fastening ring belonging to the cartridge of FIG. 2.
Figure 4:
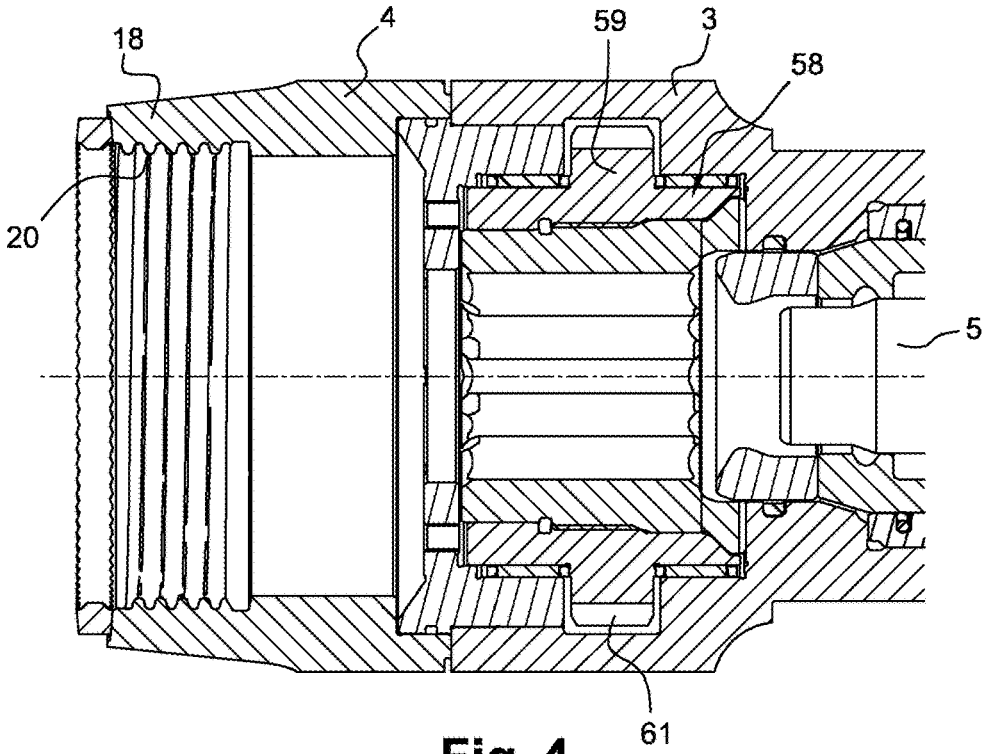
FIG. 4 is a partial longitudinal sectional view of a front part of the hydraulic drilling apparatus of FIG. 1.

The cartridge 15 further includes an injection part 21 removably mounted on a mounting portion 22 of the support body 16 opposite the mounting portion 17. As shown in FIG. 3, the injection part 21 includes a tubular injection body 23 extending around the shank 6.

The injection body 23 includes a supply inlet 24 fluidly connected to a fluid delivery conduit 25, and an inner annular groove 26 into the bottom of which the supply inlet 24 opens. The communication orifice 14 provided on the shank 6 opens into the annular inner groove 26 such that the fluid injection conduit 12 is fluidly connected to the fluid delivery conduit 25 through the annular inner groove 26 and the supply inlet 24. The fluid delivered by the fluid delivery conduit 25 may for example be water or air.

As shown in FIG. 3, the injection part 21 further comprises a joining member 27 mounted on the supply inlet 24 and on which the fluid delivery conduit 25 is mounted.

The injection part 21 further comprises an annular seal 28 mounted in an annular slot 29 formed on the outer surface of the injection body 23. The annular seal 28 may, for example, be made of polyurethane, and may for example have an annular outer flat.

The cartridge 15 further comprises a fastening ring 31 removably mounted, for example by screwing, on the support body 16. According to the embodiment represented in the figures, the fastening ring 31 comprises, on its inner surface, a thread arranged to cooperate with a complementary thread provided on the outer surface the support body 16.

The fastening ring 31 is configured for fastening, when mounted on the support body 16, the injection part 21 on the support body 16. The annular seal 28 is more particularly configured to be interposed between the fastening ring 31 and the support body 16 so as to make a sealing between the fastening ring 31 and the support body 16.

The cartridge 15 includes two annular seals (not shown in the figures) housed respectively in two annular slots 32 formed on the inner surface of the injection body 23 on either side of the annular inner groove 26. The two annular seals are configured to cooperate with the outer surface of the shank 6.

The cartridge 15 further includes a guide ring 33 mounted on the support body 16 and disposed around the guided portion 11 of the shank 6. The guide ring 33 is configured to slidably cooperate with the outer surface of the guided portion 11.

Figure 2:
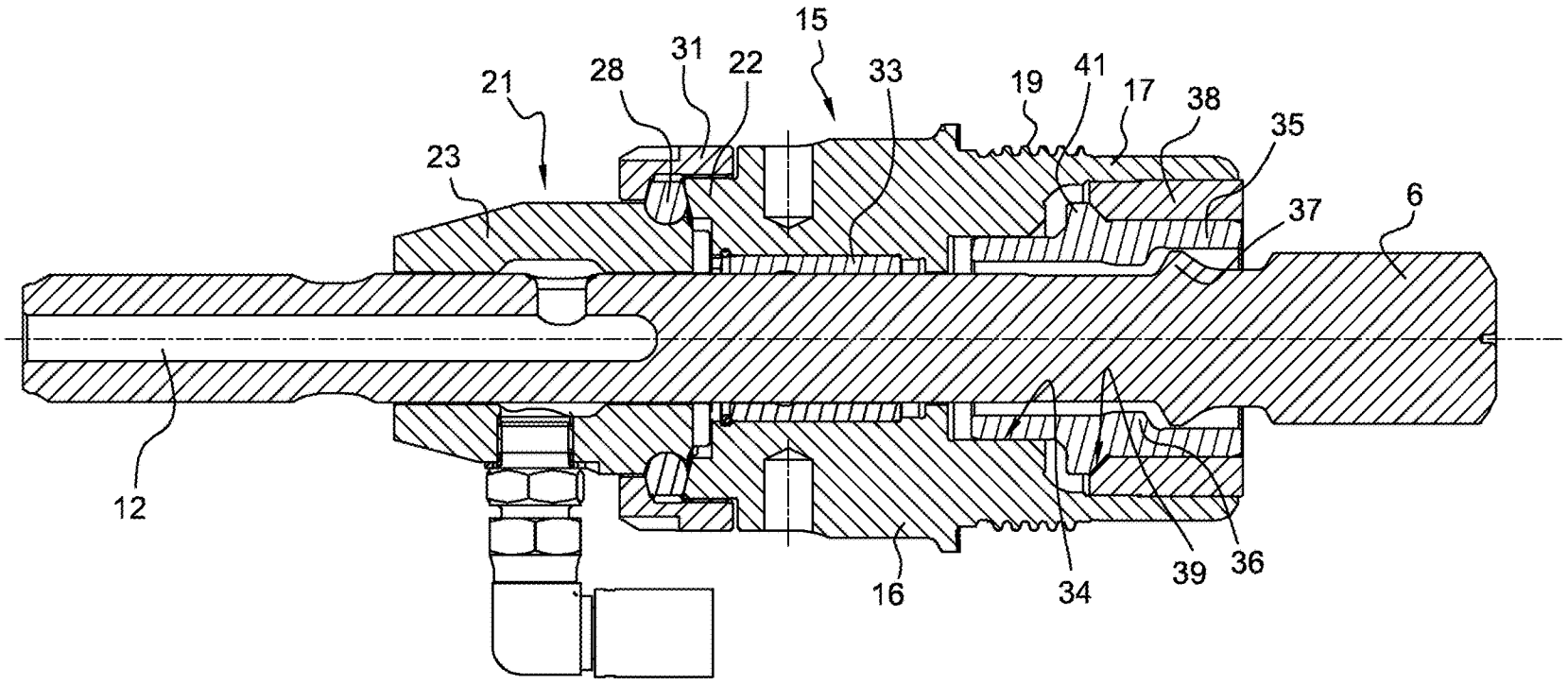
FIG. 2 is a longitudinal sectional view of a cartridge and a shank belonging to the hydraulic drilling apparatus of FIG. 1.

As shown in particular in FIG. 2, the mounting portion 17 of the support body 16 delimits at least partially a receiving housing 34 in which a tubular extraction piston 35 disposed around the shank 6 is slidably mounted.

The extraction piston 35 comprises, on its inner surface, an annular extraction portion 36 configured to cooperate with an annular bearing collar 37 provided on the outer surface of the shank 6. The annular bearing collar 37 is more particularly disposed between the guided portion 11 and the first end portion 7 of the shank 6.

The cartridge 15 further includes a retaining ring 38 disposed around the extraction piston 35 and configured to retain the extraction piston 35 in the receiving housing 34. According to an embodiment shown in the figures, the retaining ring 38 is removably mounted on the support body 16, for example by screwing.

The retaining ring 38 is more particularly configured to limit the displacement stroke of the extraction piston 35 towards the striking piston 5, and thus advantageously includes a stop surface 39 against which a bearing collar 41 provided on the outer surface of the extraction piston 35 is capable of bearing. The drilling apparatus 2 is configured such that, in the rest position, the extraction piston 35 occupies the position shown in FIG. 5, that is to say a position in which the bearing collar 41 bears against the stop surface 39.

Figure 5:
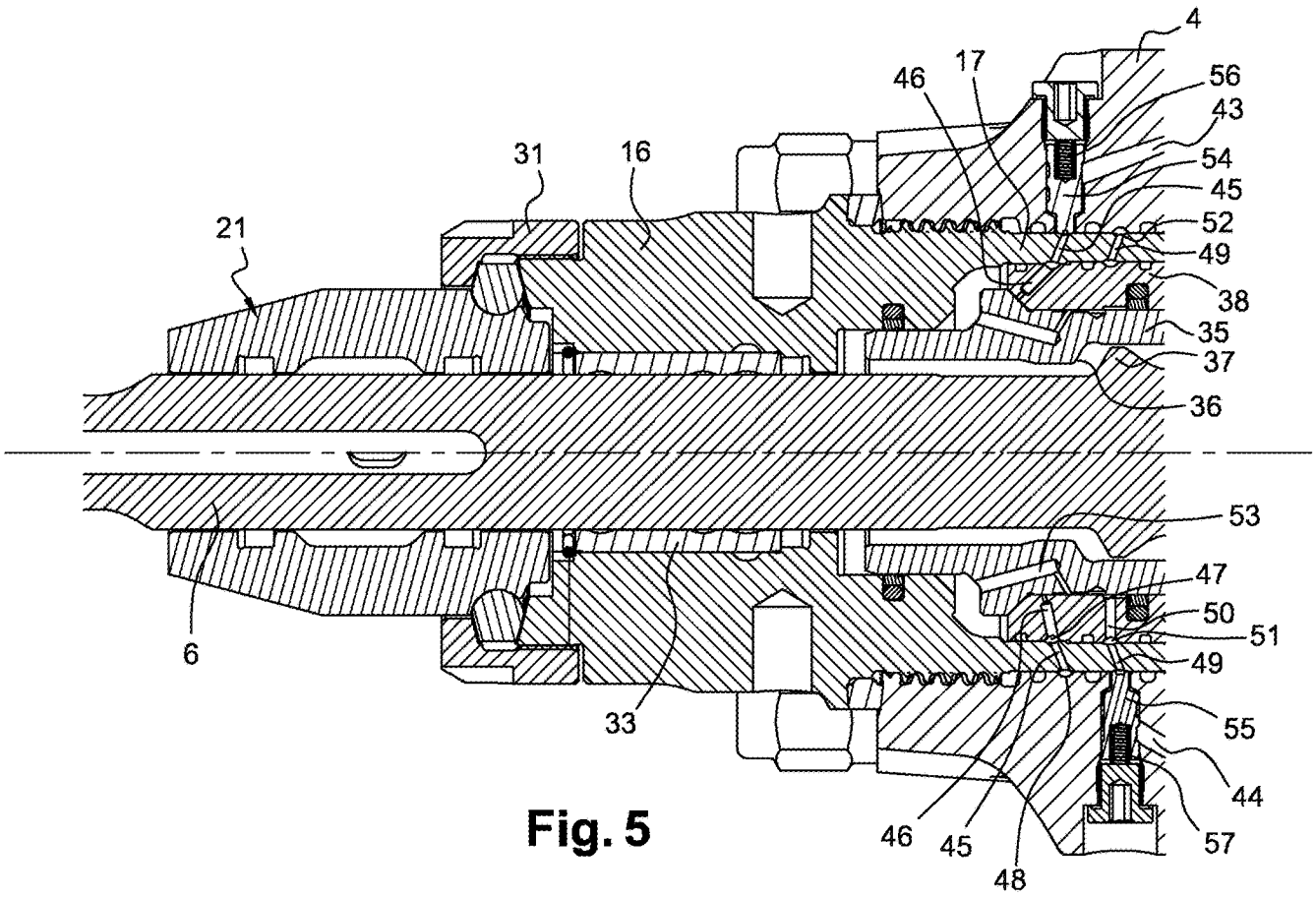
FIG. 5 is a partial longitudinal sectional view of the hydraulic drilling apparatus of FIG. 1.

As shown more particularly in FIG. 5, the support body 16, the extraction piston 35 and the retaining ring 38 delimit an annular recoil chamber 42.

The hydraulic drilling apparatus 2 further comprises a high-pressure incompressible fluid supply conduit 43 and a low-pressure incompressible fluid return conduit 44 at least partially formed on the front part 4 of the casing 3. The high-pressure incompressible fluid supply conduit 43 and the low-pressure incompressible fluid return conduit 44 each open into the inner surface of the mounting portion 18 of the front part 4.

The cartridge 15 further comprises a supply circuit configured to be fluidly connected to the high-pressure incompressible fluid supply conduit 43 when the cartridge 15 is mounted on the front part 4, and a return circuit configured to be fluidly connected to the low-pressure incompressible fluid return conduit 44 when the cartridge 15 is mounted on the front part 4. The supply circuit is more particularly configured to fluidly connect the high-pressure incompressible fluid supply conduit 43 to the recoil chamber 42 when the extraction piston 36 is not in its rest position, that is to say when the bearing collar 41 is moved away from the stop surface 39, while the return circuit is more particularly configured to fluidly connect the low-pressure incompressible fluid return conduit 44 to the recoil chamber 42.

The supply circuit comprises one or more connecting channel(s) 45 provided on the support body 16 and one or more connecting channel(s) 46 provided on the retaining ring 38. The connecting channels 46 are fluidly connected to the connecting channels 45 through an annular inner groove 47 delimited by the mounting portion 17 and the retaining ring 38. Each connecting channel 45 opens into an annular outer groove 48 delimited by the mounting portion 17 and the front part 4, and is configured to be connected to the high-pressure incompressible fluid supply conduit 43. Each connecting channel 46 opens into the recoil chamber 42, and is configured to be obturated by the extraction piston 35 when said extraction piston is in the rest position and to be released when the bearing collar 41 is moved away from the stop surface 39.

The return circuit comprises one or more connecting channel(s) 49 provided on the support body 16, and at least one connecting channel 50 provided on the retaining ring 38. The connecting channel 50 is fluidly connected to the connecting channels 49 through an annular inner groove 51 delimited by the mounting portion 17 and the retaining ring 38 and axially offset from the annular inner groove 47. Each connecting channel 49 is configured to be connected to the low-pressure incompressible fluid return conduit 44, and opens into an annular outer groove 52 delimited by the mounting portion 17 and the front part 4 and axially offset relative to the annular outer groove 48. The connecting channel 50 is fluidly connected to at least one connecting channel 53 provided on the extraction piston 35 and opening into the recoil chamber 42.

The supply circuit, the return circuit, the recoil chamber 42, and the extraction piston 35 are configured such that, when a shock wave coming from the impact of the striking piston 5 against the shank 6 is transmitted to the extraction piston 35 through the bearing collar 37 of the shank 6 and that the extraction piston 35 is projected opposite to the retaining ring 38, the recoil chamber 42 is supplied with high-pressure incompressible fluid and the incompressible fluid contained in the recoil chamber 42 therefore exerts a thrust force biasing the extraction piston 35 towards the retaining ring 38. Such rebound of the extraction piston 35 induces an impact of the bearing collar 41 of the extraction piston 35 against the bearing collar 37 of the shank 6, which allows ensuring an easy release of the tool after making the borehole.

The hydraulic drilling apparatus 2 comprises a first obturation member 54 movably mounted on the front part 4 between an obturation position of the high-pressure incompressible fluid supply conduit 43 and an opening position of the high-pressure incompressible fluid supply conduit 43, and a second obturation member 55 movably mounted on the front part 4 between an obturation position of the low-pressure incompressible fluid return conduit 44 and an opening position of the low-pressure incompressible fluid return conduit 44. The cartridge 15 is configured to bias, when mounted on the front part 4, the first and second obturation members 54, 55 towards the opening position thereof.

The hydraulic drilling apparatus 2 also comprises a first and a second biasing elements 56, 57 arranged to bias respectively the first and second obturation members 54, 55 towards the obturation position thereof.

The configuration of the first and second biasing elements 56, 57 and of the cartridge 15 ensures an automatic closing of the high-pressure incompressible fluid supply conduit 43 and the low-pressure incompressible fluid return conduit 44 during the disassembly of the cartridge 15 and an automatic opening of the high-pressure incompressible fluid supply conduit 43 and the low-pressure incompressible fluid return conduit 44 during the mounting of the cartridge 15. These dispositions thus allow in particular avoiding hydraulic leaks during the disassembly of the cartridge, and soil pollution.

The hydraulic drilling apparatus 2 further comprises a drive device 58 configured to drive the shank 6 in rotation about an axis of rotation coincident with the striking axis A.

The drive device 58 includes in particular a drive motor (not shown in the figures) mounted on the front part 4 and equipped with an output shaft. The drive motor is advantageously hydraulic.

The drive device 58 further includes a coupling pinion 59 disposed around the shank 6 and coupled in rotation with the shank 6. The coupling pinion 59 includes for example a plurality of longitudinal ribs distributed over its inner surface and configured to cooperate with complementary longitudinal grooves provided on the outer surface of the end portion 7 of the shank 6. The coupling pinion 59 is further provided, on its outer surface, with a peripheral toothing 61 directly or indirectly coupled in rotation with the output shaft of the drive motor.

It goes without saying that the invention is not limited to the sole embodiment of this hydraulic drilling apparatus, described hereinabove by way of example, it encompasses, on the contrary, all the variants.

The invention claimed is:

1. A hydraulic drilling apparatus intended to drill boreholes, comprising:

a casing comprising a front part;

a shank intended to be coupled to at least one drill rod equipped with a tool, the shank including a fluid injection conduit;

a striking piston slidably mounted inside the casing along a striking axis (A) and configured to strike the shank;

an extraction piston disposed around the shank, the extraction piston comprising an extraction portion configured to cooperate with the shank;

a cartridge removably mounted on the front part and disposed around the shank, the cartridge delimiting a receiving housing in which the extraction piston is slidably mounted, the cartridge including:

an injection part intended to be connected to a fluid delivery conduit, the injection part being configured to fluidly connect the fluid injection conduit to the fluid delivery conduit, a support body removably mounted on the front part, the support body including a first end portion facing the front part and delimiting at least partially the receiving housing, and a second end portion opposite to the first end portion and on which the injection part is removably mounted, the first end portion of the support body forming a threaded mounting portion configured to cooperate with a complementary tapped mounting portion provided on the front part; and a high-pressure incompressible fluid supply conduit, and wherein the cartridge and the extraction piston delimit at least partially a recoil chamber configured to be connected to the high-pressure incompressible fluid supply conduit; and at least one obturation member movably mounted on the front part between an obturation position of the high-pressure incompressible fluid supply conduit and an opening position of the high-pressure incompressible fluid supply conduit, the cartridge being configured to bias, when mounted on the front part, the at least one obturation member towards the opening position thereof.

2. The hydraulic drilling apparatus according to claim 1, wherein the cartridge comprises a fastening member removably mounted on the support body, the fastening member being configured to fasten the injection part on the support body.

3. The hydraulic drilling apparatus according to claim 1, wherein the injection part includes an injection body disposed around the shank, the injection body comprising a supply inlet intended to be connected to the fluid delivery conduit and an annular inner groove fluidly connected to the supply inlet, the shank including a communication orifice configured to fluidly connect the annular inner groove and the fluid injection conduit.

4. The hydraulic drilling apparatus according to claim 1, which further comprises a drive device configured to drive the shank in rotation about an axis of rotation substantially coincident with the striking axis (A).

5. The hydraulic drilling apparatus according to claim 1, wherein the cartridge includes at least one retaining member configured to retain the extraction piston in the receiving housing.

6. The hydraulic drilling apparatus according to claim 1, wherein the cartridge includes a supply circuit configured to fluidly connect the high-pressure incompressible fluid.

7. The hydraulic drilling apparatus according to claim 1, which includes a biasing element mounted on the front part and arranged to bias the at least one obturation member towards the obturation position thereof.

8. The hydraulic drilling apparatus according to claim 2, wherein the injection part includes an injection body disposed around the shank, the injection body comprising a supply inlet intended to be connected to the fluid delivery conduit and an annular inner groove fluidly connected to the supply inlet, the shank including a communication orifice configured to fluidly connect the annular inner groove and the fluid injection conduit.

9. The hydraulic drilling apparatus according to claim 2, which further comprises a drive device configured to drive the shank in rotation about an axis of rotation substantially coincident with the striking axis (A).

10. The hydraulic drilling apparatus according to claim 3, which further comprises a drive device configured to drive the shank in rotation about an axis of rotation substantially coincident with the striking axis (A).

11. The hydraulic drilling apparatus according to claim 8, which further comprises a drive device configured to drive the shank in rotation about an axis of rotation substantially coincident with the striking axis (A).

12. The hydraulic drilling apparatus according to claim 2, wherein the cartridge includes at least one retaining member configured to retain the extraction piston in the receiving housing.

13. The hydraulic drilling apparatus according to claim 3, wherein the cartridge includes at least one retaining member configured to retain the extraction piston in the receiving housing.

14. The hydraulic drilling apparatus according to claim 4, wherein the cartridge includes at least one retaining member configured to retain the extraction piston in the receiving housing.

15. The hydraulic drilling apparatus according to claim 11, wherein the cartridge includes at least one retaining member configured to retain the extraction piston in the receiving housing.

16. A hydraulic drilling apparatus intended to drill boreholes, comprising:

a casing comprising a front part;

a shank intended to be coupled to at least one drill rod equipped with a tool, the shank including a fluid injection conduit;

a striking piston slidably mounted inside the casing along a striking axis (A) and configured to strike the shank;

an extraction piston disposed around the shank, the extraction piston comprising an extraction portion configured to cooperate with the shank;

a cartridge removably mounted on the front part and disposed around the shank, the cartridge delimiting a receiving housing in which the extraction piston is slidably mounted, the cartridge including:

an injection part intended to be connected to a fluid delivery conduit, the injection part being configured to fluidly connect the fluid injection conduit to the fluid delivery conduit, and a support body removably mounted on the front part, the support body including a first end portion facing the front part and delimiting at least partially the receiving housing, and a second end portion opposite to the first end portion and on which the injection part is removably mounted, the first end portion of the support body forming a threaded mounting portion configured to cooperate with a complementary tapped mounting portion provided on the front part;

a retaining ring configured to retain the extraction piston in the receiving housing and to limit a displacement stroke of the extraction piston towards the striking piston;

a high-pressure incompressible fluid supply conduit and a low-pressure incompressible fluid return conduit, the cartridge and the extraction piston delimiting at least partially a recoil chamber configured to be connected to the high-pressure incompressible fluid supply conduit;

the cartridge further including:

a supply circuit configured to fluidly connect the high-pressure incompressible fluid supply conduit to the recoil chamber when the extraction piston is located away from the retaining ring and configured to fluidly isolate the high-pressure incompressible fluid supply conduit from the recoil chamber when the extraction piston is in a rest position in which the extraction piston bears against the retaining ring; and a return circuit configured to fluidly connect the low-pressure incompressible fluid return conduit to the recoil chamber.

* * * * *